US008353855B2

(12) United States Patent
Ingrao et al.

(10) Patent No.: US 8,353,855 B2
(45) Date of Patent: Jan. 15, 2013

(54) THERAPEUTIC SYSTEM

(76) Inventors: Jason V. Ingrao, Davis, CA (US); Justin G. Nelson, West Sacramento, CA (US)

( * ) Notice: Subject to any disclaimer, the term of this patent is extended or adjusted under 35 U.S.C. 154(b) by 727 days.

(21) Appl. No.: 12/585,195

(22) Filed: Sep. 8, 2009

(65) Prior Publication Data

US 2010/0063427 A1 Mar. 11, 2010

Related U.S. Application Data

(60) Provisional application No. 61/136,509, filed on Sep. 10, 2008.

(51) Int. Cl.
*A61H 7/00* (2006.01)

(52) U.S. Cl. ..... 601/89; 601/90

(58) Field of Classification Search ..... 128/870; 602/32–36; 601/5, 33, 34, 84, 86, 89, 90
See application file for complete search history.

(56) References Cited

U.S. PATENT DOCUMENTS

| | | | | |
|---|---|---|---|---|
| 2,949,911 | A * | 8/1960 | Kennard et al. | 601/26 |
| 3,060,925 | A * | 10/1962 | Honsaker et al. | 601/24 |
| 3,420,229 | A * | 1/1969 | Miller | 606/243 |
| 4,059,255 | A | 11/1977 | Perold | |
| 4,357,982 | A | 11/1982 | Yamada et al. | |
| 4,462,579 | A | 7/1984 | Satake | |
| 4,890,604 | A * | 1/1990 | Nelson | 602/32 |
| 5,299,334 | A | 4/1994 | Gonzalez | |
| 5,572,569 | A | 11/1996 | Benoit et al. | |
| 5,667,529 | A | 9/1997 | Butner | |
| 6,120,468 | A * | 9/2000 | Tseng | 601/46 |
| 6,212,712 | B1 | 4/2001 | Topp | |
| 6,375,355 | B1 | 4/2002 | Fortin | |
| 2007/0043308 | A1 * | 2/2007 | Lee | 601/34 |

FOREIGN PATENT DOCUMENTS

| | | |
|---|---|---|
| EP | 0100729 | 2/1984 |
| FR | 2570274 | 3/1986 |

* cited by examiner

*Primary Examiner* — Michael A. Brown
(74) *Attorney, Agent, or Firm* — Richard C. Litman

(57) ABSTRACT

The therapeutic system provides an oscillatory, pivoting table for applying motion-induced therapeutic sensory stimuli to a user. Further, therapeutic audio and visual output may be provided to the user during the application of the therapeutic sensory stimuli. The therapeutic system includes a base having an upper vertex. A tabletop is pivotally mounted to the upper vertex of the base, and the upper surface of the tabletop is adapted for supporting the user. At least one piston is provided, with the lower end thereof being mounted within the base, and the upper end thereof being pivotally mounted to a lower surface of the tabletop in order to pivot the table with respect to the base in a controlled, oscillatory manner. Oscillation of the table at a user-controlled frequency and angle induces the therapeutic sensory stimuli in the user.

5 Claims, 6 Drawing Sheets

THERAPEUTIC SYSTEM

CROSS-REFERENCE TO RELATED APPLICATION

This application claims the benefit of U.S. Provisional Patent Application Ser. No. 61/136,509, filed Sep. 10, 2008.

BACKGROUND OF THE INVENTION

1. Field of the Invention

The present invention relates to devices designed to promote mental and physical relaxation, and particularly to a therapeutic system that includes a table that pivots in a user-controlled oscillatory manner and that preferably is accompanied by appropriate auditory and visual stimulus to promote the reduction of stress.

2. Description of the Related Art

Relief of daily stress is of the highest importance to both the physical and psychological well being of all human beings. Stress is the consequence of the failure of the body or mind to adapt to change. In medical terms, stress is the consequence of the disruption of homeostasis through physical or psychological stimuli. Stress is the condition that results when person-environment interaction leads someone to perceive a painful discrepancy, real or imagined, between the demands of a situation on the one hand and their social, biological, or psychological resources on the other. Stressful stimuli may be mental, physiological, anatomical or physical.

Chronic stress is stress that lasts a long time or occurs frequently. Chronic stress is potentially damaging, both physically and psychologically. Family problems, a difficult class at school, a schedule that is too busy, or a long illness are all examples of situations that can cause chronic stress. Symptoms of chronic stress include eating disorders, upset stomachs, headaches, backaches, insomnia, anxiety, depression and anger.

In severe cases, chronic stress can lead to obsessive compulsive disorder, panic attacks, panic disorder, or other severe psychological disorders. There are a variety of methods to control chronic stress, including exercise, a healthy diet, stress management, relaxation techniques, adequate rest, and relaxing hobbies.

Stress management encompasses techniques intended to equip a person with effective coping mechanisms for dealing with psychological stress, with the stress in this context generally being defined as a person's physiological response to an internal or external stimulus that triggers the fight-or-flight response. Stress management is effective when a person utilizes strategies to cope with or alter stressful situations, though, unfortunately, stress management techniques are largely psychotherapeutic in nature, and require a great deal of time to apply in order to provide long-term health benefits.

A relaxation technique (also known as relaxation training) is any method, process, procedure, or activity that helps a person to relax, to attain a state of increased calmness, or otherwise reduce levels of anxiety, stress or tension. Relaxation techniques are often employed as one element of a wider stress management program and can decrease muscle tension, lower the blood pressure and slow heart and breath rates, among other health benefits. Relaxation techniques, such as meditation, for example, also take a great deal of time to learn and apply.

It has been found that there is a large, recent upsurge in the number of people who suffer from chronic stress in our society. A very large number of these new cases suffer from insomnia, and even greater numbers suffer from severe medical conditions, such as cardiovascular disorders. Due to the obvious physical effects, a large number of people are treating their stress with medication, such as anti-anxiety medications and sleeping pills. It would be desirable to provide a therapeutic system and method for aiding in the alleviation of stress, which may be applied quickly, without having to teach the patient a wide variety of techniques in advance, and which does not require the aid of pharmaceutical treatment. It would be desirable for such a method and system to reach every facet of personalized preventative medicine programs. Thus a therapeutic system solving the aforementioned problems is desired.

SUMMARY OF THE INVENTION

The therapeutic system provides an oscillatory, pivoting table for providing a therapeutic sensory stimulus for the user that relieves stress. Further, therapeutic audio and visual output may be provided to the user during the application of the motion-induced therapeutic sensory stimulus. The table includes a base, which may be pyramidal in shape. A table is pivotally mounted on the upper vertex of the pyramidal base, and the upper surface of the table is adapted for comfortably supporting the user.

In one embodiment, at least one hydraulic piston is provided, with the lower end thereof being mounted within the base and the upper end thereof being pivotally mounted to the lower surface of the table in order to rotate the table with respect to the base in a controlled, oscillatory manner. Oscillation of the table at a user-controlled frequency and angle provides the therapeutic sensory stimulus to the user, and further increases blood flow throughout the body due to inclination and declination of the user's body. User-selectable audio may be provided by headphones or the like and visual images may be provided by virtual reality goggles or the like while the user experiences the motion-induced sensory stimulus to provide a stress-relieving experience. The system is relatively easy to use, provides the user with beneficial biofeedback, and may be used in a wide variety of settings, such as high-stress environments like busy offices.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention relates to a therapeutic system that includes a table that provides the user with a motion-induced therapeutic sensory stimulus, and may also provide the user with therapeutic audio and visual sensory effects in order to enhance the feeling of therapeutic stress relief. The "balance therapy" provided by the pivoting table, as will be described below in greater detail, increases blood flow throughout the user's body in a controlled manner, due to the controlled inclination and declination of the table, and further simulates gravitational freefall, due to the oscillatory effects of the user's inner ear balance.

Figure 1:
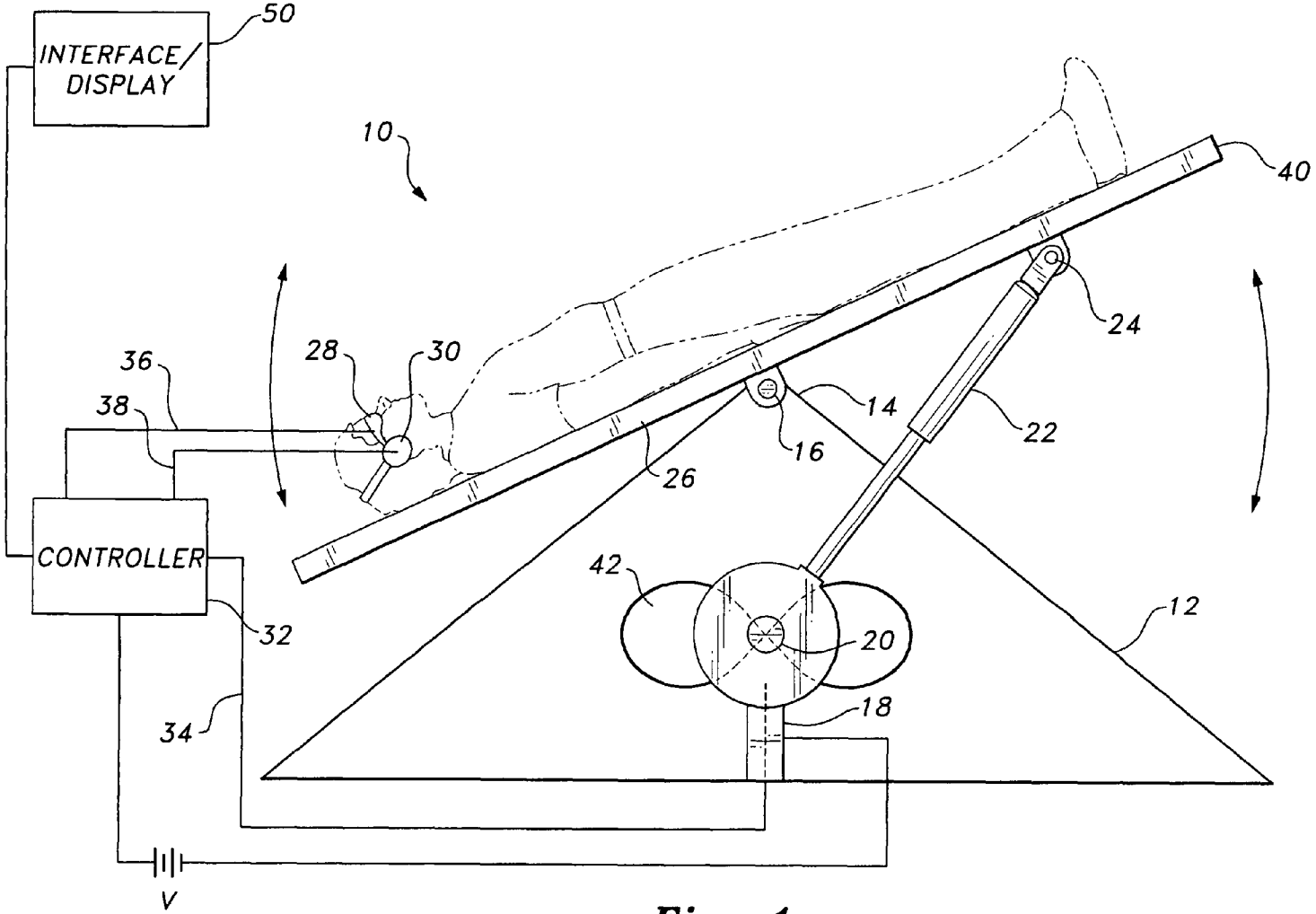
FIG. 1 is a side view of a therapeutic system according to the present invention, showing the table in a first angular position.
Figure 2:
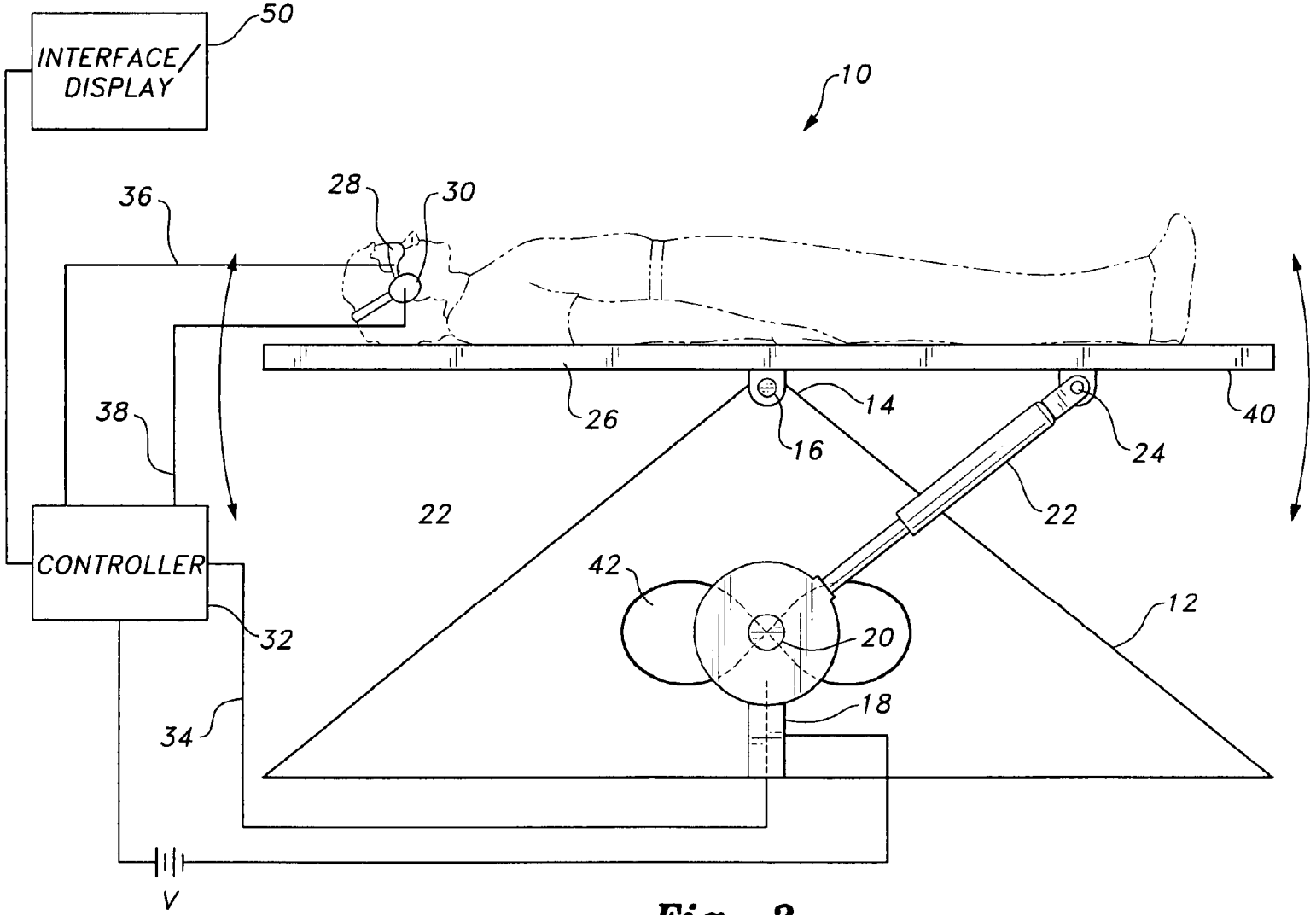
FIG. 2 is a side view of the therapeutic system according to the present invention, showing the table pivoted to a second, substantially horizontal angular position.
Figure 3:
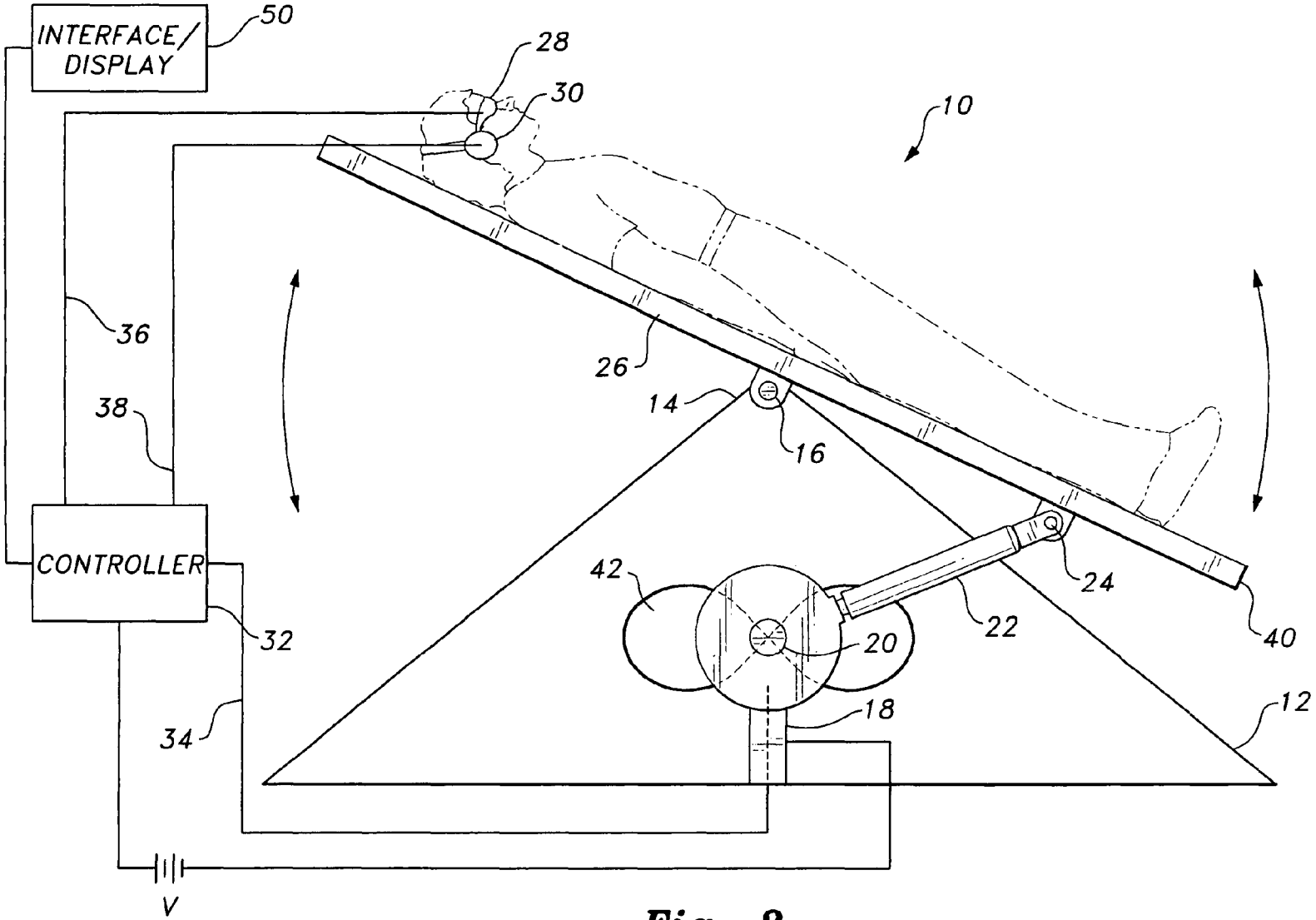
FIG. 3 is a side view of the therapeutic system according to the present invention, showing the table pivoted to a third angular position.

As shown in FIGS. 1-3, in a first embodiment, the table includes a base 12, which preferably has a substantially pyramidal shape. It should be understood that base 12 may alternatively be a triangular prism, or have any other suitable configuration or dimensions. A tabletop 40, which may be rectangular, square, round, or any other desired shape, is pivotally mounted by a pivoting joint or the like to the vertex 14 of the base 12. A longitudinal support plate 26 is preferably attached to the lower surface of the tabletop 40. For a pyramidal base 12, the plate 26 may be pivotally attached to the vertex 14 of the base 12 by a ball and socket joint or the like that permits pivoting in any radial direction from the vertex 14. It should be understood that any suitable pivotal connection may be utilized. For a triangular prism base 12, the plate 26 may have a central pair of parallel lugs that can be aligned with a bore defined through a cylinder extending across the vertex 14 of the base 12 through which pivot pin 16 is inserted, as shown in FIG. 1, which permits pivoting about an axis defined by the pin 16, similar to a seesaw or teeter-totter. Tabletop 40 is adapted for comfortably supporting the user, and may have any desired dimensions or configuration. In the Figures, element 42 is a decorative element, shaped like the symbol representing infinity. It should be understood that any suitable decorative elements may be applied to system 10, dependent upon the desires of the user without departing from the spirit or scoped of the claimed invention.

A support pedestal 18 is disposed within the base 12 for supporting an axle or motor shaft 20, which may be a crankshaft, similar to an automobile engine crankshaft. At least one hydraulic cylinder piston 22 is attached to shaft or axle 20 and project outwardly therefrom. A clevis at the end of the at least one hydraulic cylinder is pivotally attached to plate 26 by pivot pin 24 to one end of longitudinal support 26. Although shown as a single hydraulic piston bearing against a cam wheel or axle 20 in the drawings, it will be understood that a plurality of pistons 22 may be attached to plate 26 and may bear against a sphere having multiple cam lobes to cause pivoting in any radial direction, if desired. Piston 22 is preferably hydraulic, but may be pneumatic, or of any suitable, controllable type that provides a degree of shock absorption for gradual and smooth pivoting, preventing herky-jerky pivoting of tabletop 40. Shaft or axle 20 may be actuated by a motor or other suitable power source that causes the axle 20 to oscillate for powering hydraulic pistons 22. The alternative embodiment of FIG. 4, to be described in detail below, uses an alternative linear actuator-based control. It should be understood that any suitable type of driven oscillatory motion may be utilized without departing from the spirit or scope of the system as claimed.

In use, a separate controller 32 may be pre-programmed or controlled by an operator to generate control signals, delivered by control line 34 to a motor that actuates shaft 20. The control signals actuate the motor to power the hydraulic cylinder, thus causing the table 40 to pivot about vertex 14 in an oscillatory manner (as shown in the progression from FIG. 1 to FIG. 2 to FIG. 3) with a user-selectable frequency. This oscillatory rotation of table 40 will provide the user with a motion-induced therapeutic sensory stimulus. The frequency of oscillation may be varied as well as the angle of declination, thus allowing for multiple types of sensory experiences to be applied to the user, from a resting, stable horizontal position, to positions and motions that simulate gravitational freefall. Table 40 preferably rotates to angles of approximately 10° with respect to the horizontal. Controller 32 further controls the angle of rotation in addition to the frequency of oscillation. Preferably, table 40 oscillates at up to 30 cycles per minute. Controller 32 may be a programmable logic controller, or any other suitable control device capable of generating control signals and, as described below, providing recorded audio and video signals to the user. In addition to providing sensory stimulation, the pivoting of table 40 also increases the flow of blood throughout the user's body in a controlled manner, due to the inclination and declination of the body.

In addition to the motion-induced effects, the user may be provided with virtual reality goggles 28, or any other suitable visual display, and a pair of headphones 30, or any other suitable source of audio effects. Goggles 28 and headphones 30 are powered and controlled by controller 32 through control lines 36, 38 thereto, respectively. Pleasurable and therapeutic audio and visual effects are generated by controller 32 and transmitted to the user during use of the system. The user may sample a variety of audio and visual effects, with preferences being saved for future therapeutic treatments. Controller 32 and the motor may be powered by any suitable power source V. Controller 32 preferably includes a computer storage memory, for recording audio and video in digital format, and for further recording user preferences with regard to audio, video and oscillation frequency. The motion-induced therapeutic effects, audio and video effects are used to alleviate psychological and physical stress in the user.

Additionally, as shown, a user interface coupled with a display 50 is further provided, in communication with controller 32. The interface and display may be provided in the form of a touchscreen, for example, allowing the user to easily program the controller 32. Programming may consist of a plurality of screens provided to the user, such as introductory screen, providing basic information and instructions, followed by a duration programming menu. The user may input a desired time of usage, such as five minutes, ten minutes, fifteen minutes, etc. Once time is input, the user may then be taken a third menu, allowing the user to input control settings. For example, the user may be provided with options to control desired amplitude of oscillation, from an arcuate traveled distance between approximately ¾ of an inch to twenty inches, for example. The user may then program a desired oscillatory frequency, which is preferably in the range of approximately five to nine cycles per minute (though it should be understood that the frequency is variable and may be adjusted to the user's preference). The rotation is preferably very gentle for the user. As an example, at a minimal rotational speed and maximal amplitude setting, a full oscillatory cycle should take approximately ten minutes to complete. A manual control setting for setting angle of rotation relative to the horizontal may also be provided. Additionally, the table may be adjusted to position the user's head or the user's feet closer to the ground for a longer duration, depending upon the user's preferences.

Once the user's full cycle of usage is complete, the tabletop 40 is preferably rotated as in the orientation of FIG. 3, with the user's feet being positioned as close to the ground as possible, in order to prevent risk of injury upon exiting the system 10. Controller 32 may be any suitable type of microcontroller, microprocessor, digital signal processor, or the like. Additionally, as noted above, any suitable type of display or interface 50 may be provided to the user, allowing the user to program the controller 32. The controller 32 may be associated with, or incorporated into, any suitable type of computing device, for example, a personal computer. The controller 32 may include computer-readable memory, a communication system for remote programming or access, or any other desired components typically associated with programmable controllers, computers and the like. The memory, communication system, interface/display 50 and any other components of system 10, are in communication with one another by any suitable type of data bus, as is well known in the art. The memory may be any suitable type of memory. Examples of recording media include a magnetic recording apparatus, an optical disk, a magneto-optical disk, and/or a semiconductor memory (for example, RAM, ROM, flash memory, etc.).

Figure 4:
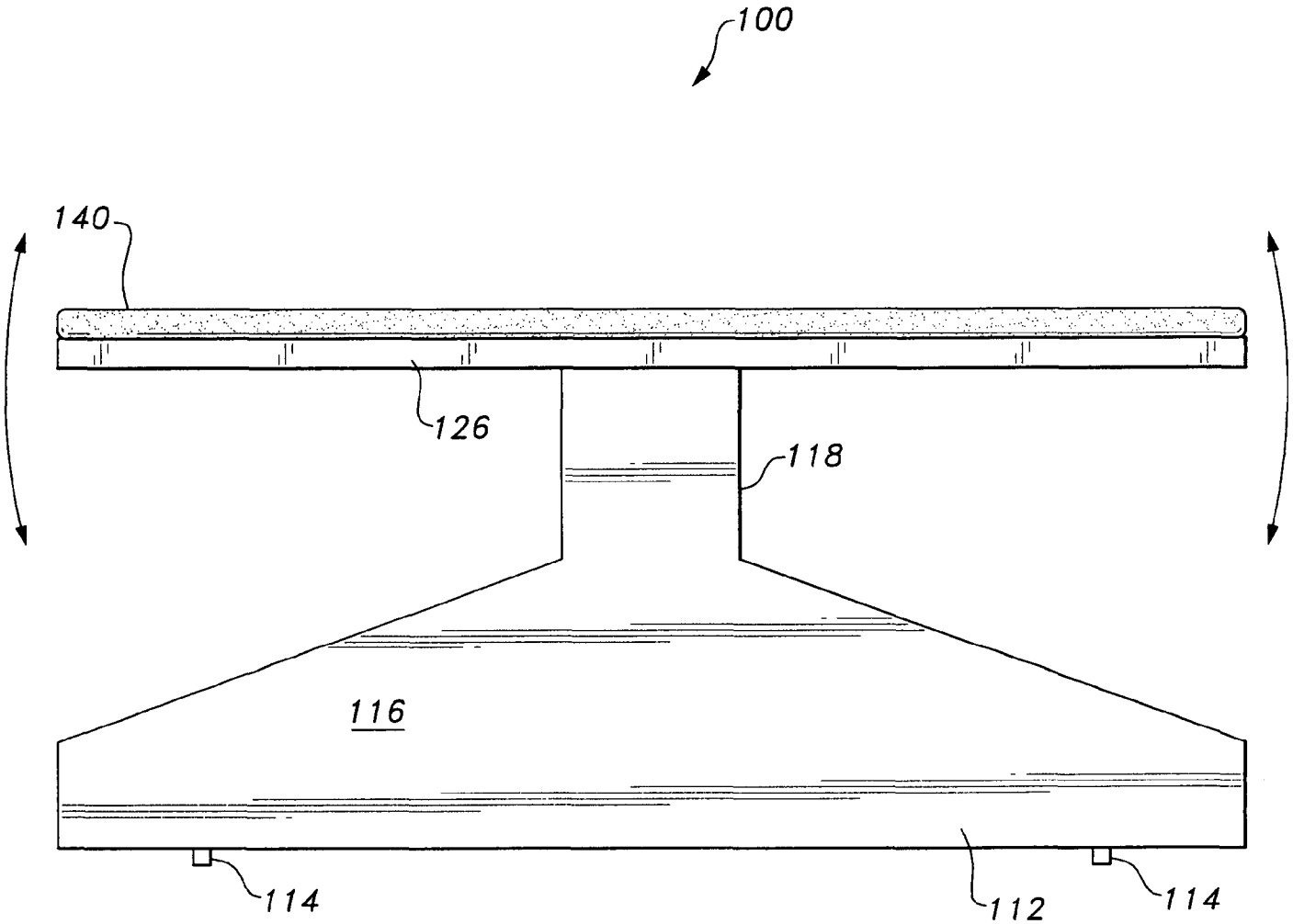
FIG. 4 is a side view of an alternative embodiment of the therapeutic system according to the present invention.
Figure 5:
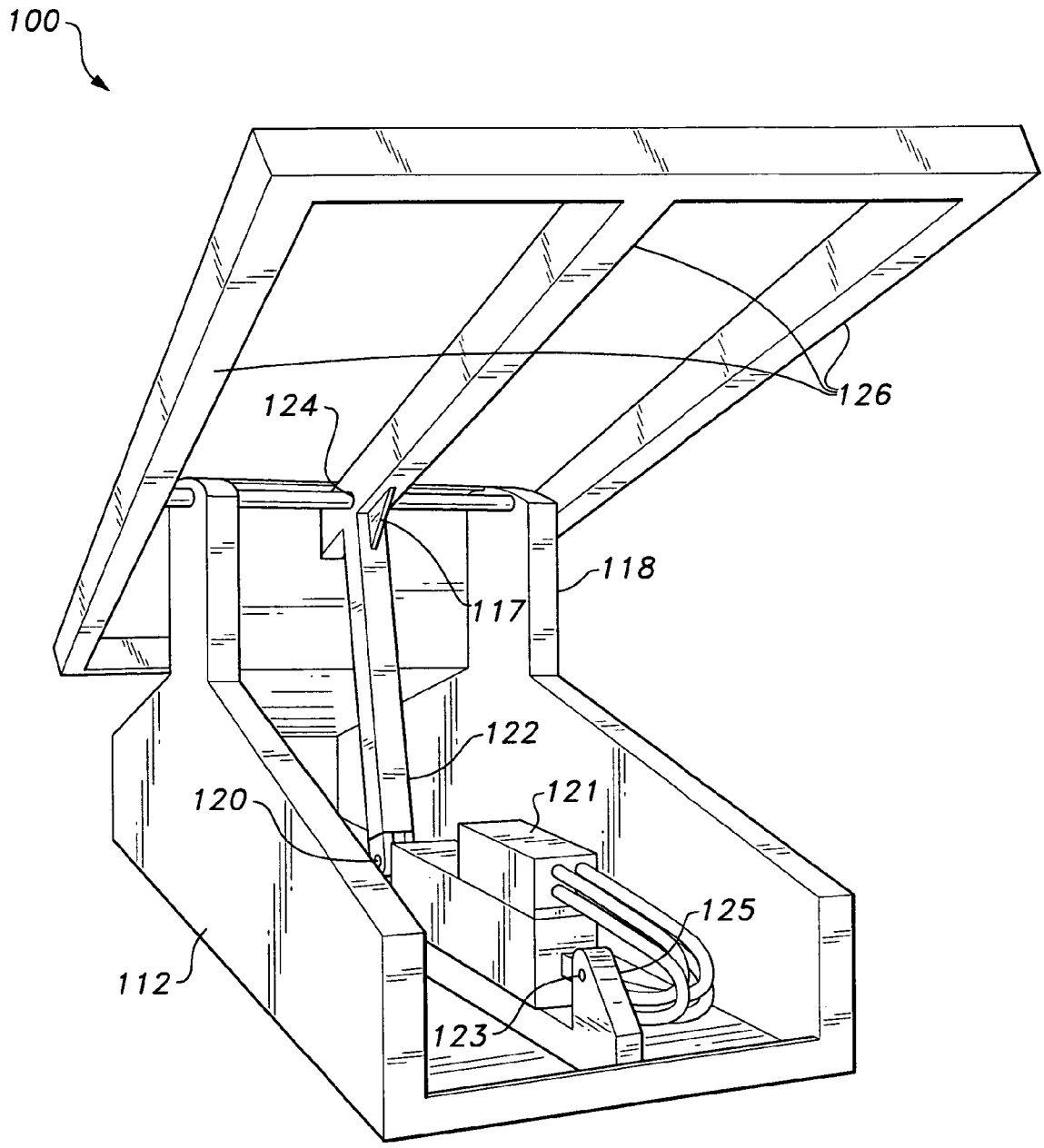
FIG. 5 is a perspective view of the therapeutic system of FIG. 4.

As noted above, the shape of base 12 may be varied without altering the functioning of the overall system. System 100 of FIGS. 4 and 5 is similar to system 10, including a base 112 having a support 126 pivotally mounted thereto. Separate mounts or supports 114 may be secured to the lower edge of the lower portion 116 of base 112, as shown, depending upon the particular type of support surface upon which the system 100 rests. Lower portion 116, in this example, has a substantially trapezoidal contour, and an upper portion 18 having a substantially rectangular contour projects upwardly therefrom.

Figure 6:
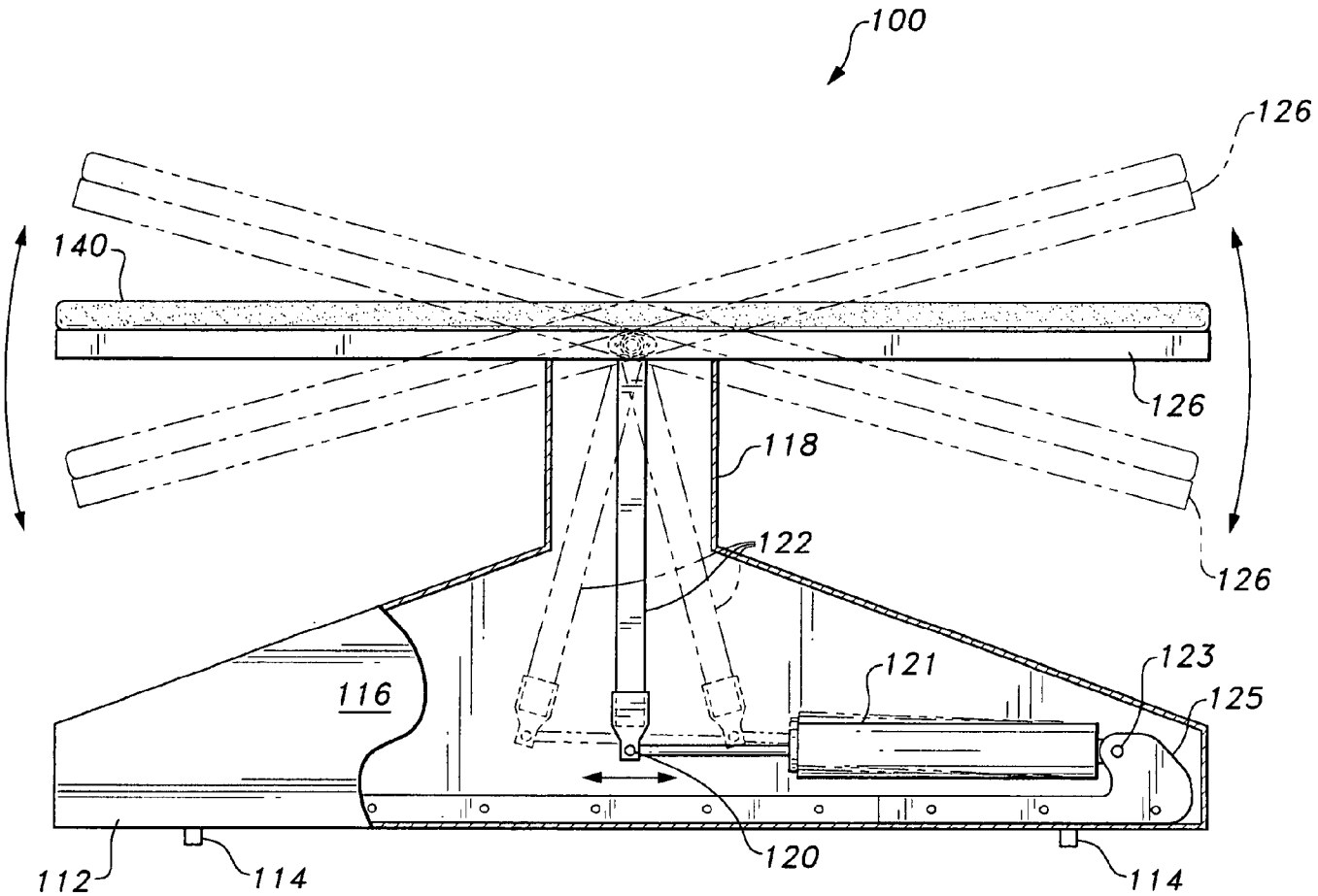
FIG. 6 is a side, partially cut-away view of the therapeutic system of FIG. 4.

In FIG. 4, a cushioned tabletop 140 rests on support 126, and in FIG. 5, cushioned tabletop 140 has been removed for purposes of illustration and clarification. As shown, support 126 may be formed as a plurality of elongated bars or rods in order to decrease overall weight and moment of inertia. It should be understood that support 126 may have any desired configuration. As best shown in FIG. 6, the hydraulic piston of system 10 has been replaced in system 100 with an arm 122 that is pivotally attached at 120 to a piston of a linear actuator 121. Linear actuator 121 may be a hydraulic piston, a pneumatic piston, electric cylinder and piston, or any other suitable type of linear actuator. Linear actuator 121 is pivotally secured to base 112 by a pivotal connection 123 on one end thereof to a mount 125. The other end is pivotally attached to the lower end of arm 122 by pivot 120. A clevis at the upper end of the arm 122 is pivotally attached to support 126 (shown here as being attached to the central elongated rod or bar of support 126) by a pivot pin. Although shown as a single arm 122 in the drawings, it will be understood that a plurality of arms 122 may be attached to support 126. Additionally, supports 126 may include any suitable additional means of structural support or stability, such as brace 117, for example.

It should be understood that piston 22 of system 10 and the arm 122 and linear actuator of system 100 are shown for exemplary purposes only. Any suitable type of oscillating drive may be utilized, with a piston which may be hydraulic, pneumatic, or of any suitable, controllable type that provides a degree of shock absorption for gradual and smooth pivoting, preventing herky-jerky pivoting of tabletop 140, or with an arm or other oscillating support which is actuated by a linear actuator 121, motor or other suitable power source that causes the axle 120 to oscillate and drive oscillatory movement of the tabletop. Actuator 121 may include a surge protector or any other desired electrical elements typically associated therewith. For base 112, the support 126 preferably includes a central pair of parallel lugs that can be aligned with a bore defined through upper portion 118, through which pivot pin or rod 124 is inserted, as shown in FIGS. 5 and 6, which permits pivoting about an axis defined by the pivot rod 124, similar to a seesaw or teeter-totter. In this embodiment, it should be understood that the display, controller and interface of the previous embodiment are utilized, though not shown (for illustrative purposes). The logo may be positioned as shown in FIGS. 1-3, and the exemplary touchscreen may be mounted to the front of the system. It should be understood that any suitable ornamentation, such as element 42, may be positioned on any suitable site of the system. Similarly, the controller and/or interface and/or display may also be positioned at any suitable location with respect to the system, such as, for example, the touchscreen mounted directly to surface 116 in FIG. 4, or mounted thereabove by a suitable support.

The therapeutic system may be used in any desired environment in order to induce a therapeutic effect in the user, particularly in stimulating blood flow within the user's body, due to the oscillation of the tabletop, and providing a deeply relaxing state for the user. For example, the system may be placed in military or veteran's hospitals, a workplace environment for employees' well being, health clubs and resorts, rehabilitation centers, airports, hospitals, geriatric departments, hospice centers, research facilities, or be provided to any individual, family, group, company, or other organization, who seek to relax, meditate, manage blood flow, and control the ill effects of stress. Further, it should be understood that the overall configuration of the system may be varied, dependent upon the particular location or usage. For example, the system could be sized and contoured as a baby's crib.

It is to be understood that the present invention is not limited to the embodiment described above, but encompasses any and all embodiments within the scope of the following claims.

We claim:

1. A therapeutic table, comprising:

a base defining a vertex;

a tabletop pivotally mounted on the vertex of the base wherein the tabletop consists of only a planar support surface;

at least one piston pivotally attached to the base and to the tabletop; and;

means for selectively and controllably extending and retracting the at least one piston in order to produce oscillation of the tabletop whereby the flow of blood throughout a user's body is stimulated due to the inclination and declination of the body from the horizontal, wherein said means to produce oscillation further comprises means for selectively and adjustably controlling the oscillation amplitude, oscillation frequency and oscillation period, thereby applying motion-induced therapeutic sensory stimuli simulating gravitational freefall to a user resting on the tabletop.

2. The therapeutic table as recited in claim 1, wherein said at least one piston is a hydraulic cylinder, the at least one piston having opposed upper and lower ends, the upper end thereof being pivotally secured to the tabletop, the lower end thereof being pivotally secured to the base.

3. The therapeutic table as recited in claim 2, wherein said means for selectively and controllably extending and retracting the at least one piston in order to produce oscillation of the tabletop further comprises means for selectively and adjustably controlling oscillation amplitude.

4. The therapeutic table as recited in claim 3, wherein said means for selectively and controllably extending and retracting the at least one piston in order to produce oscillation of the tabletop further comprises means for selectively and adjustably controlling oscillation frequency.

5. The therapeutic table as recited in claim 4, wherein said means for selectively and controllably extending and retracting the at least one piston in order to produce oscillation of the tabletop further comprises means for selectively and adjustably controlling oscillation period.

* * * * *